US006871176B2

(12) United States Patent
Choi et al.

(10) Patent No.: US 6,871,176 B2
(45) Date of Patent: Mar. 22, 2005

(54) PHASE EXCITED LINEAR PREDICTION ENCODER

(75) Inventors: Hung-Bun Choi, Mong Kok (HK); Wing Tak Kenneth Wong, North Point (HK)

(73) Assignee: Freescale Semiconductor, Inc., Austin, TX (US)

( * ) Notice: Subject to any disclaimer, the term of this patent is extended or adjusted under 35 U.S.C. 154(b) by 781 days.

(21) Appl. No.: 09/915,893

(22) Filed: Jul. 26, 2001

(65) Prior Publication Data

US 2003/0074192 A1 Apr. 17, 2003

(51) Int. Cl.[7] ..... G10L 19/12
(52) U.S. Cl. ..... 704/223; 704/219; 704/222
(58) Field of Search ..... 704/219, 220, 704/222, 223, 230, 208

(56) References Cited

U.S. PATENT DOCUMENTS

| | | | | |
|---|---|---|---|---|
| 5,293,448 A | | 3/1994 | Honda | 395/2.17 |
| 5,517,595 A | | 5/1996 | Kleijn | 395/2.14 |
| 5,754,974 A | | 5/1998 | Griffin et al. | 704/206 |
| 5,774,837 A | | 6/1998 | Yeldener et al. | 704/208 |
| 5,809,456 A | | 9/1998 | Cucchi et al. | 704/217 |
| 5,845,244 A | | 12/1998 | Proust | 704/220 |
| 6,041,297 A | | 3/2000 | Goldberg | 704/219 |
| 6,067,511 A | | 5/2000 | Grabb et al. | 704/223 |
| 6,070,137 A | | 5/2000 | Bloebaum et al. | 704/227 |
| 6,119,082 A | | 9/2000 | Zinser, Jr. et al. | 704/223 |
| 6,233,550 B1 | * | 5/2001 | Gersho et al. | 704/208 |
| 6,636,829 B1 | * | 10/2003 | Benyassine et al. | 704/201 |
| 6,782,360 B1 | * | 8/2004 | Gao et al. | 704/222 |

OTHER PUBLICATIONS

"Speech Compression," Internet Webpage http://www.data-compression.com/speech.html, Mar. 12, 2001,10 pp.
"Two-mode Pitch-Synchronous Waveform Interpolation (TPSWI) Model," by Choi, published in the Ph.D. Thesis, University of Liverpool, Jan. 1997, pp. 134–172. chap. 5.
"A 2.4 KBIT/S MELP Coder Candidate for the New U.S. Federal Standard," by McCree et al., published in the IEEE Proc. ICASSP 1996, pp. 200–203.
"Encoding Speech Using Prototype Waveforms" by Kleijn, published in the IEEE Transactions on Speech and Audio Processing, vol. 1, No. 4, Oct. 1993, pp. 396–399.

* cited by examiner

*Primary Examiner*—Susan McFadden
(74) *Attorney, Agent, or Firm*—Charles E. Bergere; Joanna G. Chiu; Robert L. King

(57) ABSTRACT

A low bit rate phase excited linear prediction type speech encoder filters a speech signal to limit its bandwidth and then fragments the filtered speech signal into speech segments. The speech segments are decomposed into a spectral envelope and an LP residual signal. The spectral envelope is represented by LP filter coefficients. The LP filter coefficients are converted into line spectral frequencies (LSF). Each speech segment is also classified as one of a voiced segment and an unvoiced segment based on a pitch of the segment. Parameters are extracted from the LP residual signal, where for an unvoiced segment the extracted parameters include pitch and gain and for a voiced segment the extracted parameters include pitch, gain and excitation level. The extracted parameters are then quantized.

42 Claims, 4 Drawing Sheets

PHASE EXCITED LINEAR PREDICTION ENCODER

BACKGROUND OF THE INVENTION

1. Field of the Invention

The present invention relates to speech coding algorithms and, more particularly to a Phase Excited Linear Predictive (PELP) low bit rate speech synthesizer and a pitch detector for a PELP synthesizer.

2. Background of Related Art

Mobile communications are growing at a phenomenal rate due to the success of several different second-generation digital cellular technologies, including GSM, TDMA and CDMA. To improve data throughput and sound quality, considerable effort is being devoted to the development of speech coding algorithms. Indeed, speech coding is applicable to a wide range of applications, including mobile telephony, internet phones, automatic answering machines, secure speech transmission, storing and archiving speech and voice paging networks.

Waveform codecs are capable of providing good quality speech at bit rates down to about 16 kbits/s, but are of limited use at rates lower than 16 kbit/s. Vocoders on the other hand can provide intelligible speech at 2.4 kbits/s and below, but cannot provide natural sounding speech at any bit rate. Hybrid codecs attempt to fill the gap between waveform and source codecs. The most commonly used hybrid codecs are time domain Analysis-by-Synthesis (AbS) codecs. Such codecs use the same linear prediction filter model of the vocal tract as found in Linear Predictive Coding (LPC) vocoders. However, instead of applying a simple two-state, voiced/unvoiced, model to find the necessary filter input, the excitation signal is chosen by matching the reconstructed speech waveform as closely as possible to the original speech waveform.

The distinguishing feature of AbS codecs is how the excitation waveform for the synthesis filter is chosen. AbS codecs split the input speech to be coded into frames, typically about 20 ms long. For each frame, parameters are determined for a synthesis filter, and then the excitation to the synthesis filter is determined by finding the excitation signal which when passed into the synthesis filter minimizes the error between the input speech and the reconstructed speech. Thus, the encoder analyses the input speech by synthesizing many different approximations to the input speech. For each frame, the encoder transmits information representing the synthesis filter parameters and the excitation to the decoder and, at the decoder, the given excitation is passed through the synthesis filter to generate the reconstructed speech. However, the numerical complexity involved in passing every possible excitation signal through the synthesis filter is quite large and thus, must be reduced, but without significantly compromising the performance of the codec.

The synthesis filter is usually an all pole, short-term, linear filter intended to model the correlations introduced into speech by the action of the vocal tract. The synthesis filter may also include a pitch filter to model the long-term periodicities present in voiced speech. Alternatively these long-term periodicities may be exploited by using an adaptive codebook in the excitation generator so that the excitation signal includes a component of the estimated pitch period.

There are various kinds of AbS codecs, such as Multi-Pulse Excited (MPE), Regular-Pulse Excited (RPE), and Code-Excited Linear Predictive (CELP). Generally MPE and RPE codecs will work without a pitch filter, although their performance will be improved if one is included. For CELP codecs a pitch filter is extremely important.

The differences between MPE, RPE and CELP codecs arise from the representation of the excitation signal. In MPE codecs, the excitation signal is given by a fixed number of non-zero pulses for every frame of speech. The positions of these non-zero pulses within the frame and their amplitudes must be determined by the encoder and transmitted to the decoder. In theory it is possible to find the best values for all the pulse positions and amplitudes, but this is not practical due to the excessive complexity required. In practice some sub-optimal method of finding the pulse positions and amplitudes must be used. Typically about 4 pulses per 5 ms can be used for good quality reconstructed speech at a bit-rate of around 10 kbits/s.

Like the MPE codec, the RPE codec uses a number of non-zero pulses to represent the excitation signal. However, the pulses are regularly spaced at a fixed interval, and the encoder only needs to determine the position of the first pulse and the amplitude of all the pulses. Therefore less information needs to be transmitted about pulse positions, so for a given bit rate the RPE codec can use more non-zero pulses than the MPE codec. For example, at a bit rate of about 10 kbits/s around 10 pulses per 5 ms can be used, compared to 4 pulses for MPE codecs. This allows RPE codecs to give slightly better quality reconstructed speech than MPE codecs.

Although MPE and RPE codecs provide good quality speech at rates of around 10 kbits/s and higher, they are not suitable for lower rates due to the large amount of information that must be transmitted about the excitation pulses' positions and amplitudes. If the bit rate is reduced by using fewer pulses or by coarsely quantizing the pulse amplitudes, the reconstructed speech quality deteriorates rapidly.

Currently the most commonly used algorithm for producing good quality speech at rates below 10 kbits/s is CELP. CELP differs from MPE and RPE in that the excitation signal is effectively vector quantized. The excitation signal is given by an entry from a large vector quantizer codebook and a gain term to control its power. The codebook index is represented with about 10 bits and the gain is coded with about 5 bits. Thus, the bit rate necessary to transmit the excitation information is about 15 bits. CELP coding has been used to produce toll quality speech communications at bit rates between 4.8 and 16 kbits/s.

It is an object of the present invention to provide an efficient speech coding algorithm operable at low bit rates yet capable of reproducing high quality speech.

SUMMARY OF THE INVENTION

The present invention provides a speech encoder including a content extraction module, a pitch detector, and a naturalness enhancement module. The content extraction module includes a band pass filter that receives a speech input signal and generates a band limited speech signal. A first speech buffer connected to the band pass filter stores the band limited speech signal. An LP analysis block, connected to the first speech buffer, reads the stored speech signal and generates a plurality of LP coefficients therefrom. An LPC to LSF block connected to the LP analysis block converts the LP coefficients to a line spectral frequency (LSF) vector. An LP analysis filter connected to the LPC to LSF block extracts an LP residual signal from the LSF vector. An LSF quantizer connected to the LPC to LSF block receives the LSF vector and determines an LSF index therefore. The pitch detector is connected to the LP analysis block of the content extraction module. The pitch detector classifies the band filtered speech signal as one of a voiced signal and an unvoiced signal. The naturalness enhancement module is connected to the content extraction module and the pitch detector. The naturalness enhancement module includes a means for extracting parameters from the LP residual signal, where for an unvoiced signal the extracted parameters include pitch and gain and for a voiced signal the extracted parameters include pitch, gain and excitation level. A quantizer quantizes the extracted parameters and generating quantized parameters.

In another embodiment, the present invention provides a content extraction module for a speech encoder. The content extraction module includes a band pass filter that receives a speech input signal and generates a band limited speech signal, and a first speech buffer connected to the band pass filter that stores the band limited speech signal. An LP analysis block connected to the first speech buffer reads the stored speech signal and generates a plurality of LP coefficients therefrom. An LPC to LSF block connected to the LP analysis block converts the LP coefficients to a line spectral frequency (LSF) vector. An LP analysis filter connected to the LPC to LSF block extracts an LP residual signal from the LSF vector, and an LSF quantizer connected to the LPC to LSF block receives the LSF vector and determines an LSF index therefor.

In a further embodiment, the present invention provides a naturalness enhancement module for a speech encoder, where the speech encoder includes a pitch detector for determining whether an input speech signal is a voiced signal or an unvoiced signal and a content extraction module for generating an LP residual signal from the input speech signal. The naturalness enhancement module includes a means for extracting parameters from the LP residual signal, where for an unvoiced signal the extracted parameters include pitch and gain and for a voiced signal the extracted parameters include pitch, gain and excitation level, and a quantizer for quantizing the extracted parameters and generating quantized parameters.

In a further embodiment, the present invention provides a pitch detector for a speech encoder. The pitch detector includes a first operation level for analyzing a speech signal and, based on a first predetermined ambiguity value of the speech signal, generating a first estimated pitch period. A second operation level analyzes the speech signal and, based on a second predetermined ambiguity value of the speech signal, generates a second estimated pitch period.

In yet another embodiment, the present invention provides a speech signal preprocessor for preprocessing an input speech signal prior to providing the speech signal to a speech encoder. The preprocessor includes a band pass filter that receives the speech input signal and generates a band limited speech signal, and a scale down unit connected to the band pass filter for limiting a dynamic range of the band limited speech signal.

The present invention also provides a method of encoding a speech signal, including the steps of filtering the speech signal to limit its bandwidth, fragmenting the filtered speech signal into speech segments, and decomposing the speech segments into a spectral envelope and an LP residual signal. The spectral envelope is represented by a plurality of LP filter coefficients (LPC). Then, the LPC are converted into a plurality of line spectral frequencies (LSF) and each speech segment is classified as one of a voiced segment and an unvoiced segment based on a pitch of the segment. Next, parameters are extracted from the LP residual signal, where for an unvoiced segment the extracted parameters include pitch and gain and for a voiced segment the extracted parameters include pitch, gain and excitation level. Finally, the extracted parameters are quantized to generate quantized parameters.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments that are presently preferred. It should be understood, however, that the invention is not limited to the precise arrangements and instrumentalities shown. In the drawings.

DETAILED DESCRIPTION OF PREFERRED EMBODIMENTS

Figure 1:
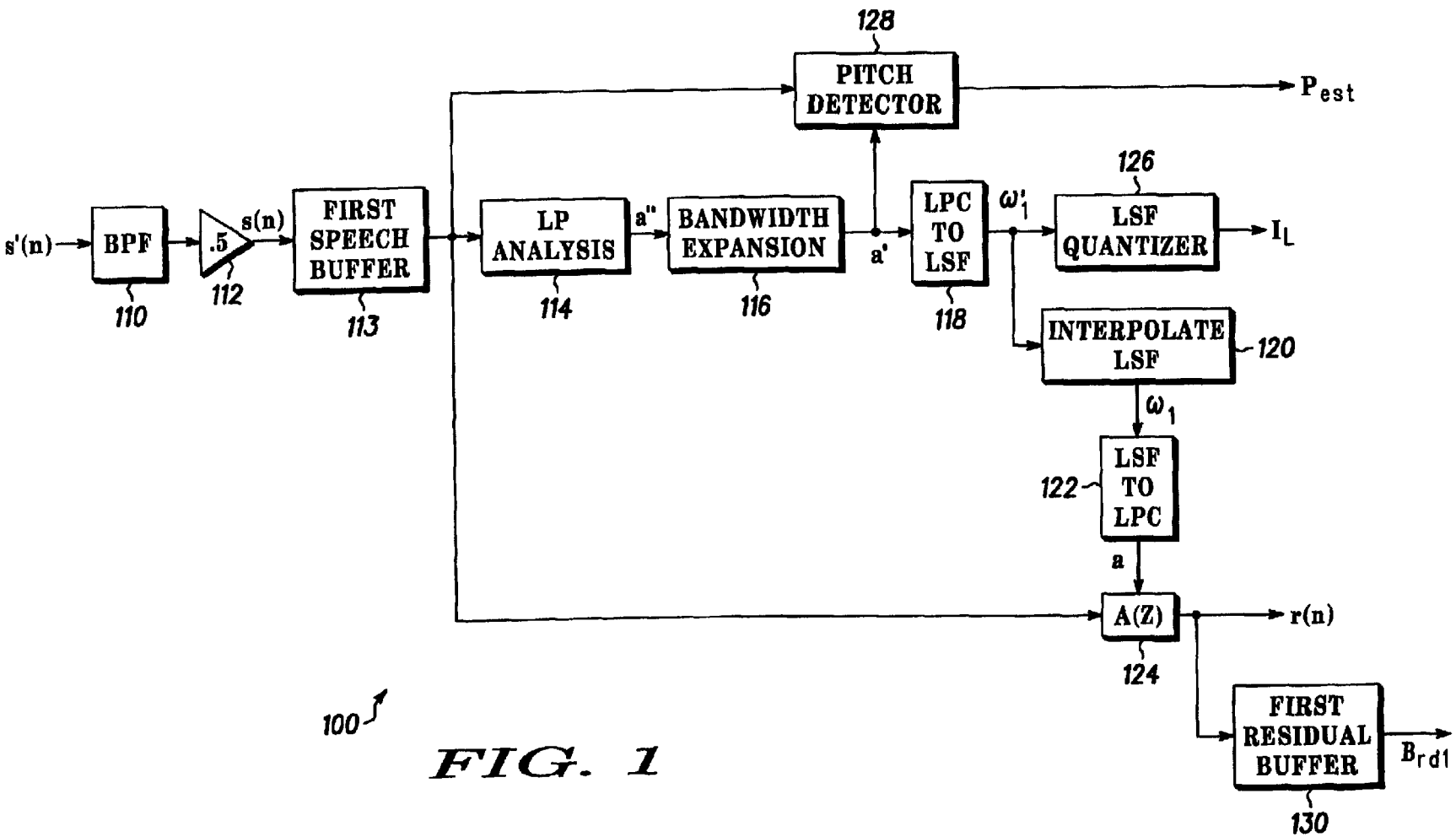
FIG. 1 is a schematic block diagram of a content extraction module of a PELP encoder in accordance with the present invention.

The detailed description set forth below in connection with the appended drawings is intended as a description of the presently preferred embodiments of the invention, and is not intended to represent the only forms in which the present invention may be practiced. It is to be understood that the same or equivalent functions may be accomplished by different embodiments that are intended to be encompassed within the spirit and scope of the invention. In the drawings, like numerals are used to indicate like elements throughout.

The present invention is directed to a low bit rate Phase Excited Linear Predictive (PELP) speech synthesizer. In PELP coding, a speech signal is classified as either voiced speech or unvoiced speech and then different coding schemes are used to process the two signals.

For voiced speech, the voiced speech signal is decomposed into a spectral envelope and a speech excitation signal. An instantaneous pitch frequency is updated, for example every 5 ms, to obtain a pitch contour. The pitch contour is used to extract an instantaneous pitch cycle from the speech excitation signal. The instantaneous pitch cycle is used as a reference to extract the excitation parameters, including gain and excitation level. The spectral envelope, instantaneous pitch frequency, gains and excitation level are quantized. For unvoiced speech, a spectral envelope and gain are used, together with an unvoiced indicator.

A decoder is used to synthesize the voiced speech signal. A Linear Predictive (LP) excitation signal is constructed using a deterministic signal and a noisy signal. The LP excitation signal is then passed through a synthesis filter to generate the synthesized speech signal. To synthesize the unvoiced speech signal, a unity-power white-Gaussian noise sequence is generated and normalized to the gains to form an unvoiced excitation signal. The unvoiced excitation signal is then passed through a LP synthesis filter to generate a synthesized speech signal.

PELP coding uses linear predictive coding and mixed speech excitation to produce a natural synthesized speech signal. Different from other linear prediction based coders, the mixed speech excitation is obtained by adjusting only the phase information. The phase information is obtained using a modified speech production model. Using the modified speech production model, the information required to characterize a speech signal is reduced, which reduces the data sent over the channel. The present invention allows a natural speech signal to be synthesized with few data bits, such as at bit rates from 2.0 kb/s to below 1.0 kb/s.

The present invention further provides a pitch detector for the PELP coder. The pitch detector is used to classify a speech frame as either voiced or unvoiced. For voiced speech, the pitch frequency of the voiced sound is estimated. The pitch detector is a key component of the PELP coder.

Figure 2A:
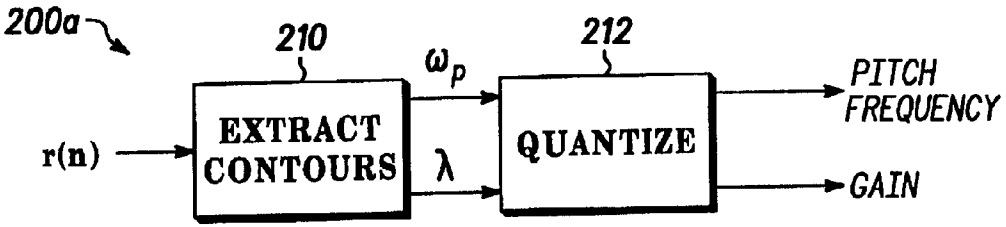
FIG. 2*a* is a schematic block diagram of a naturalness enhancement module for an unvoiced signal of a PELP encoder in accordance with the present invention.
Figure 2B:
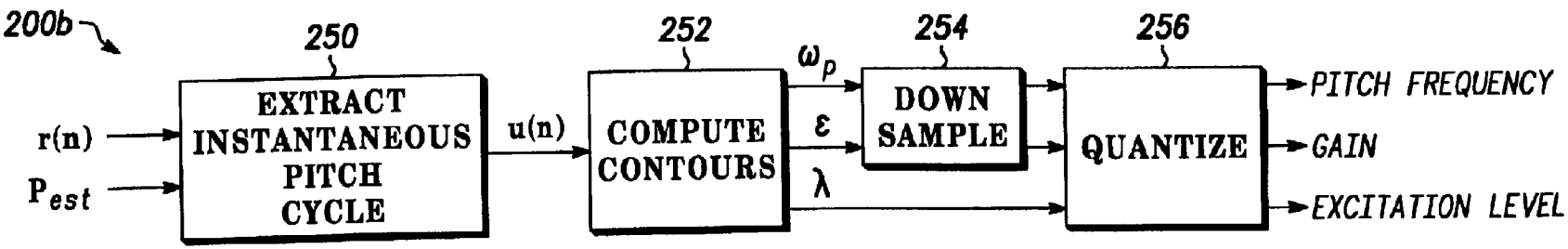
FIG. 2*b* is a schematic block diagram of a naturalness enhancement module for a voiced signal of a PELP encoder in accordance with the present invention.

Referring now to the drawings, FIGS. 1, 2*a* and 2*b* show a PELP encoder in accordance with a preferred embodiment of the present invention. The PELP encoder includes two main parts, a content extraction module 100 (FIG. 1) and a naturalness enhancement module 200*a* (FIG. 2*a*) and 200*b* (FIG. 2*b*).

The purpose of the content extraction module 100 is to extract the information content from an input speech signal s' (n). The content extraction module 100 has a preprocessing unit that includes a band pass filter (BPF) 110, a scale down unit 112, and a first speech buffer 113. The input speech signal s' (n) is provided to the BPF 110, which limits the input speech signal s' (n) from about 150 Hz to 3400 Hz. Preferably, the BPF 110 uses an eighth order IIR filter. The aim of the lower cut-off is to reject low frequency disturbances, which could be perceptually very sensitive. The upper cut-off is to attenuate the signals at the higher frequencies. The $8^{th}$ order IIR filter may be formed using a $4^{th}$ order low-pass section and a $4^{th}$ order high-pass section. The transfer functions of the low-pass and high-pass sections are defined in equations (1) and (2), respectively.

$$H_{lp1}(z) = \left(\frac{0.805551 + 1.611102z^{-1} + 0.805551z^{-2}}{1 + 1.518242z^{-1} + 0.703969z^{-2}}\right)\left(\frac{0.666114 + 1.332227z^{-1} + 0.666114z^{-2}}{1 + 1.255440z^{-1} + 0.409014z^{-2}}\right) \quad \text{Eqn 1}$$

$$H_{hp1}(z) = \left(\frac{0.953640 - 1.907280z^{-1} + 0.953640z^{-2}}{1 - 1.900647z^{-1} + 0.913913z^{-2}}\right)\left(\frac{0.898920 - 1.797840z^{-1} + 0.898920z^{-2}}{1 - 1.791588z^{-1} + 0.804093z^{-2}}\right) \quad \text{Eqn 2}$$

The BPF 110 thus produces a band-limited speech signal, which is provided to the scale down unit 112. The scale down unit 112 scales this signal down by about a half (0.5) to limit the dynamic range and hence to yield a speech signal s(n). The speech signal s(n) is segmented into frames, for example 20 ms frames, and stored in the first speech buffer 113. For an 8 kHz sampling system, a speech frame contains 160 samples. In the presently preferred embodiment, the first speech buffer 113 stores 560 samples $B_{sp1}$ (n) for n=0,559 for analysis by an LP analysis block 114. When a frame (160 samples) of the speech signal s(n) is available, it is loaded into the first speech buffer 113 from samples n=400 to 559. The samples proceeding $B_{sp1}(400)$ are made up of the previous consecutive frames.

In the presently preferred embodiment, the LP analysis block 114 performs a $10^{th}$ order Burg's LP analysis to estimate the spectral envelope of the speech frame. The LP analysis frame contains 170 samples, from $B_{sp1}(390)$ to $B_{sp1}(559)$. The result of the LP analysis is ten LP coefficients (LPC), a" (i) where i=1 to 10. A bandwidth expansion block 116 is used to expand the set of LP coefficients using equation (3), which generates bandwidth expanded LP coefficients a'(i).

$$a'(i)=0.996^i a''(i) \text{ for } i=1, 2, \ldots 10 \quad \text{Eqn 3}$$

A frame of an LP residual signal r(n) is extracted using an LP analysis filter in the following manner. After the set of bandwidth expanded LP coefficients a'(i) is generated, the coefficients a'(i) are converted to line spectral frequencies (LSF) $\omega'_l(i)$ (i=1 to 10), at an LPC to LPF block 118. The current set of LSF $\omega'_l(i)$ is then linearly interpolated with the set of the previous frame LSF at an interpolate LSF block 120 to compute a set of intermediate LSF $\omega_l(i)$, preferably every Sms. Hence there are four sets of intermediate LSF $\omega_l(m,i)$ (m=1, 4; i=1, 10) in a speech frame. The four intermediate LSF sets $\omega_l(m,i)$ are converted back to corresponding LP coefficients a(m,i) (m=1, 4; i=1, 10) at an LSF to LPC block 122. Then, a frame of the residual signal r(n) is obtained using an inverse filter 124 operating in accordance with equation (4).

$$r(n) = s(n) + \sum_{i=1}^{10} a(i)s(n-i) \quad \text{Eqn 4}$$

A first residual buffer 130 stores the residual signal r(n). The size of the first residual buffer 130 is preferably 320 samples. That is, the stored data is $B_{rd1}(n)$ for n=0 to 319, which is the current residual frame and a previous consecutive frame. To compute the current residual frame, the inverse filter 124 is operated as shown in Table 1.

TABLE 1

Method of inverse filtering to extract excitation parameters

| Filter input from $B_{sp1}$ (n) range of (n) | Filter coefficients | Filter output to $B_{rd1}$ (n) range of (n) |
|---|---|---|
| 320 to 359 | $\{a_i^{(1)}\}$ | 160 to 199 |
| 360 to 399 | $\{a_i^{(2)}\}$ | 200 to 239 |
| 400 to 439 | $\{a_i^{(3)}\}$ | 240 to 279 |
| 440 to 479 | $\{a_i^{(4)}\}$ | 280 to 319 |

The LSF $\omega'_l(i)$ from the LPC to LSF block 118 are also quantized by an LSF codebook or quantizer 126 to determine an index $I_L$. That is, as is understood by those of ordinary skill in the art, the LSF quantizer 126 stores a number of reference LSF vectors, each of which has an index associated with it. A target LSF vector $\omega'_l(i)$ is compared with the LSF vectors stored in the LSF quantizer 126. The best matched LSF vector is chosen and an index $I_L$ of the best matched LSF vector is sent over the channel for decoding.

As previously discussed, for the LP residual signal r(n), different coding schemes are used for different signal types. For a voiced segment, a pitch cycle is extracted from the LP residual signal r(n) every 5 ms, i.e. an instantaneous pitch cycle. The gain, pitch frequency and excitation level for the instantaneous pitch cycle are extracted. A consecutive set for each parameter is arranged to form a parameter contour. The sensitivity of each parameter to the synthesised speech quality is different. Hence, different update rates are used to sample each parameter contour for coding efficiency. In the presently preferred embodiment, a 5 ms update is used for gain and a 10 ms update is used for the pitch frequency and excitation level. For an unvoiced segment, only the gain contour is useful. An unvoiced sub-segment is extracted from the LP residual signal r(n) every 5 ms. The gain of each unvoiced sub-segment is computed and arranged in time to form a gain contour. Once again a 5 ms update rate is used to sample the unvoiced gain. A pitch detector 128 is used to classify the speech signal s(n) as either voiced or unvoiced. In the case of voiced speech the pitch frequency is estimated.

Figure 3:
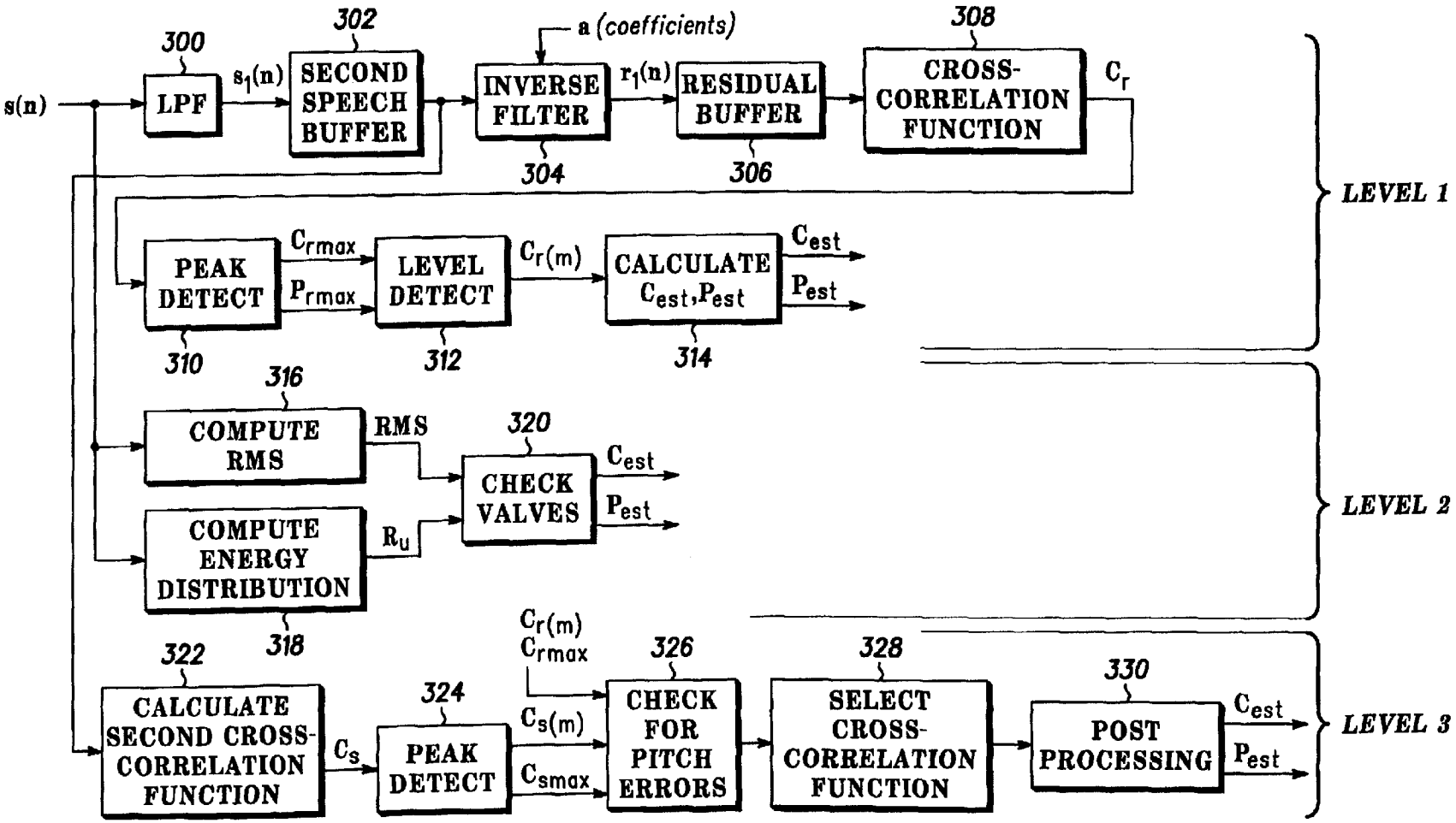
FIG. 3 is a pseudo block diagram of a pitch detector in accordance with the present invention.

Referring now to FIG. 3, a pseudo block diagram of the pitch detector 128 is shown. The pitch detection operation is divided into 3 levels, depending on the ambiguity of the speech signal s(n).

In level (1), the speech signal s(n) is filtered with a low pass filter 300 to reject the higher frequency content that may obstruct the detection of true pitch. The cut-off frequency of the low-pass filter 300 is preferably set to 1000 Hz. Preferably the filter 300 has a filter transfer function as defined in equation (5).

$$H_{lp2}(z) = \left(\frac{0.097631 + 0.195262z^{-1} + 0.097631z^{-2}}{1 - 0.942809z^{-1} + 0.333333z^{-2}}\right) \quad \text{Eqn 5}$$

The output $s_l(n)$ of the low-pass filter 300 is loaded into a second speech buffer 302. In the presently preferred embodiment, the second speech buffer 302 is used to store two consecutive frames $B_{sp2}(n)$ where n=0 to 319, which is 320 samples. More particularly, the input to the low pass filter 300 is taken from the first speech buffer 113 as $B_{sp1}(400)$ to $B_{sp1}(559)$ and a modified speech signal $s_l(n)$ output from the low pass filter 300 is stored in the second speech buffer 302 $B_{sp2}(160)$ to $B_{sp2}(319)$ The stored modified speech signal $B_{sp2}(n)$, n=160 to 319 is provided to an inverse filter 304 to obtain a band-limited residual signal $r_l(n)$. The filter coefficients of the inverse filter 304 are set to $a_i^{(4)}$ for i=0, 10. The residual signal $r_l(n)$ output from the inverse filter 304 is stored in a second residual buffer 306. The second residual buffer 306 preferably stores 320 samples $B_{rd2}(n)$ where n=0 to 319, and thus, the residual buffer 306 holds two consecutive residual frames. The current residual signal $r_l(n)$ is stored in $B_{rd2}(n)$, where n=160 to 319.

After a new residual signal $r_l(n)$ is loaded into the second residual buffer 306, a cross-correlation function is computed at block 308 using data read from the buffer 306 $B_{rd2}(n)$ in accordance with equation (6).

$$C_r(m) = \frac{\sum_{n=319}^{160} B_{rd2}(n)B_{rd2}(n-m)}{\sqrt{\sum_{n=319}^{160} B_{rd}^2(n) \sum_{n=319}^{160} B_{rd}^2(n-m)}} \quad \text{Eqn 6}$$

form = 16, 17, 18, … , 160

A peak detector 310 finds the global maximum $C_{rmax}$ and its location $P_{rmax}$, across the cross-correlation function $C_r(m)$, m=16 to 160. A level detector 312 checks if $C_{rmax}$ is greater than or equal to about 0.7, in which case the confidence for a voice signal is high. In this case, the cross-correlation function $C_r(m)$ is re-examined to eliminate possible multiple pitch errors and hence to yield the estimated pitch-period Pest and its correlation function $C_{est}$ at block 314. The multiple-pitch error checking is preferably carried out as follows:

i) set correlation threshold as $C_{th}=0.75\times C_{rmax}$ ii) set examined range from m=16 to $p_{rmax}$ iii)the estimate pitch-period is equal to the first local maximum across $C_r(m)$ for m=16 to $p_{rmax}$, in ascending order of m, which has a correlation value greater than $C_{th}$:

$$p_{est}=Pos(C_r(p))$$

$$C_{est}=C_r(p)$$

where $$C_r(p) \geqq C_{th}$$

$$16 \leqq p < p_{rmax}$$

iv)if condition (iii) is not satisfied, then $p_{est}$ and $C_{est}$ are set as:

$$p_{est}=p_{rmax}$$

$$C_{est}=C_{rmax}$$

If the level detector 312 determines that $C_{rmax}$ is less than about 0.7, level (2) pitch detection processing is used.

Level (2)

Level (2) of the pitch detector 128 is delegated to the detection of an unvoiced signal. This is done by accessing the RMS level and energy distribution $R_u$ of the speech signal s(n). The RMS value of the speech signal s(n) is computed at block 316 in accordance with equation (7).

$$\text{RMS} = \sqrt{\frac{\sum_{n=400}^{559} B_{sp1}^2(n)}{160}} \quad \text{Eqn 7}$$

The vocal tract has certain major resonant frequencies that change as the configuration of the vocal tract changes, such as when different sounds are produced. The resonant peaks in the vocal tract transfer function (or frequency response) are known as "formants". It is by the formant positions that the ear is able to differentiate one speech sound from another. The energy distribution $R_u$, defined as the energy ratio between the higher formants and all the detectable formants, for a pre-emphasized spectral envelope, is computed at block 318. The pre-emphasized spectral envelope is computed from a set of pre-emphasized filter coefficients that defines a system with the transfer function shown in equation (8).

$$A^{\#}(z)=(1+0.99z^{-1})A'(z) \quad \text{Eqn 8}$$

If a' and $a^{\#}$ are the filter coefficients for A'(z) and $A^{\#}(z)$, they are related as shown in equation (9).

$$a^{\#}_0=1.0$$

$$a^{\#}_i a'_i=0.99a'_{i-1} \text{ for } i=1,2, \ldots, 10 \quad \text{Eqn 9}$$

$$a^{\#}_{11}=0.99a'_{10}$$

After filter coefficients a# are available, a# are zero padded to 256 samples and an FFT analysis is applied to yield a smoothed spectral envelope. For example, assuming $X_k$ where k=1 to M are the magnitude values for formants (1) to (M), where formants (1) to (m) are below 2 kHz and formants (m+1) to (M) are above 2 kHz, the energy distribution is defined as:

$$R_u = \frac{\sum_{k=m+1}^{M} X_k^2}{\sum_{k=1}^{M} X_k^2} \quad \text{Eqn 10}$$

Detection of an unvoiced signal is done at block 320 by checking if either RMS is less than about 58.0 or $R_u$ is greater than about 0.5. If either of these conditions is met, an unvoiced frame is declared and $C_{est}$ and $p_{est}$ are cleared or set to zero. Otherwise, the pitch detector 128 will call upon the level (3) analysis.

Level (3)

In level (3), a cross-correlation function low-pass filtered speech signal $C_s(m)$ is computed from the low-pass filtered speech signal stored in the second speech buffer 302 using equation (11), at block 322.

$$C_s(m) = \frac{\sum_{n=319}^{160} B_{sp2}(n)B_{sp2}(n-m)}{\sqrt{\sum_{n=319}^{160} B_{sp2}^2(n) \sum_{n=319}^{160} B_{sp2}^2(n-m)}} \quad \text{Eqn 11}$$

for $m = 16, 17, 18, \ldots, 160$

A peak detector 324 is connected to the block 322 and detects the global maximum $C_{smax}$ and its location $p_{smax}$ of $C_s(m)$. The correlation function $C_s(m)$ calculated at block 322 is examined at block 326, in a similar manner as is done in level (1) with $C_r(m)$, and then the appropriate cross-correlation function $C_r(m)$ or $C_s(m)$ is selected at block 328 to eliminate multiple pitch errors.

For example, assume the estimated pitch-period and its associated correlation function for $C_r(m)$ and $C_s(m)$ are $p_{rest}$ and $C_{rest}$ and $p_{sest}$ and $C_{sest}$ respectively. The value $C_{smax}$ is then assessed and the following logic decisions are performed. If $C_{smax}$ is greater than or equal to about 0.7, a voiced signal is declared and pitch logic (1) is used to choose $p'_{est}$ from $p_{rest}$ and $p_{sest}$ and determine $C_{est}$. The estimated pitch-period $p_{est}$ is obtained by post processing $p'_{est}$. Otherwise, the sum of $C_{rmax}$ and $C_{smax}$ is computed, $C_{sum}=C_{rmax}+C_{smax}$. When the value of $C_{sum}$ is available, the logic decisions are made as follows.

If $C_{sum} \geqq 1.0$, a voiced signal is declared and pitch logic (2) is used to choose $p'_{est}$ from $p_{rest}$ and $p_{sest}$, and determine $C_{est}$. The estimated pitch-period $p_{est}$ is obtained by post-processing $p'_{est}$, as described below. Otherwise, an unvoiced signal is declared, $C_{est}=0.0$ and $p_{est}=0$.

Pitch logic (1)

For pitch logic (1), two conditions are analyzed at a first decision block:

i) Absolute difference between the two estimated pitch periods, $p_{diff}=|p_{sest}-p_{rest}|$ is checked for $p_{diff} \geqq p_{min}$, where $p_{min}$ is a minimum pitch-period that is set to 16 samples.

ii) The value of $C_{rmax}$ is assessed for $C_{rmax}>0.5$.

If both conditions are met, the probability of a multiple pitch error in one of the pitch-periods ($p_{sest}$ and $p_{rest}$) is high. Hence, the result is taken from the one with a smaller pitch-period:

if $p_{sest}>p_{rest}$, $p'_{est}=p_{rest}$ and $C_{est}=C_{rmax}$, otherwise, $p'_{est}=p_{sest}$ and $C_{est}=C_{smax}$ If either of conditions (i) and (ii) fails, the results are taken from the one with a higher correlation maximum, i.e., $p'_{est}=p_{sest}$ and $C_{est}=C_{smax}$.

Pitch logic (2)

Pitch logic (2) is a simple comparison between two correlation maximums. If $C_{smax}>C_{rmax}$, the voicing decision made from $C_s(m)$ may be high, and hence the result is taken from $C_s(m)$, $p'_{est}=p_{sest}$ and $C_{est}=C_{smax}$. Otherwise, if $C_{rmax}>C_{smax}$, then $p'_{est}=p_{rest}$ and $C_{est}=C_{rmax}$.

After the pitch period $p'_{est}$ is selected, the pitch period $p'_{est}$ is smoothed by a pitch post-processing unit 330. The pitch post-processing unit 330 is a median smoother used to smooth out an isolated error such as a multiple pitch error or a sub-multiple pitch error. In the presently preferred embodiment, the pitch post-processing unit 330 differs from conventional median smoothers, which operate on the pitch-periods taken from both the previous and future frames, because the median smoother uses the current estimated pitch-period and pitch-periods estimated in the two previous consecutive frames.

Assume the estimated pitch-period for the $l^{th}$ speech frame as p(l) and p(l−1) and p(l−2) are the estimated pitch-periods for the two previous consecutive frames.

$p(l)=p'_{est}$ $p(l-1)=p_{est}$ for $(l-1)^{th}$ frame $p(l-2)=p_{est}$ for $(l-2)^{th}$ frame Three cases are analyzed.

i) steady voicing: p(l)>0, p(l−1)>0 and p(l−2)>0 ii) voice onset (2): p(l)>0, p(l−1)>0 and p(l−2)=0 iii)voice onset (1): p(l)>0, p(l−1)=0 and p(l−2)=0

For steady voicing, the median smoother only operates when $C_{est}$ is smaller than about 0.6, which is a weak voiced signal. The median smoother takes the median value of p(1), p(l−1) and p(l−2):

$$p_{est}=\text{Median}(p(l), p(l-1), p(l-2))$$

For voice onset (2), the two estimated pitch-periods are averaged if $C_{est}<0.5$:

$$p_{est}=0.5*(p(l)+p(l-1)) \text{ for } C_{est}<0.5$$

This is done to ensure a smooth pitch-period trajectory. If $C_{est}$ is greater than or equal to 0.5, a strong enough voicing can be assumed and hence $p_{est}=p(1)$. For voice onset(1), no history of pitch-periods is available and hence the estimated value is used, $p_{est}$—p(l). Thus, the pitch detector 128 indicates estimated pitch-period $p_{est}$ and its correlation function $C_{est}$.

Referring now to FIGS. 2*a* and 2*b*, the naturalness enhancement module 200*a*/200*b* of the PELP encoder is shown. In the naturalness enhancement module 200*a*/200*b*, different analyses are carried out on the residual signal r(n) stored in the first residual buffer 130 (FIG. 1) for voiced and unvoiced signal types to extract a set of contours in order to enhance the quality of the synthetic speech. FIG. 2*a* shows the process performed on an unvoiced signal and FIG. 2*b* shows the process performed on a voiced signal.

A contour is a sequence of parameters, which in the presently preferred embodiment are updated every 5 ms. As previously discussed, the length of a speech frame is 20 ms, hence there are four (4) parameters (m) in a frame, which make up a contour. The parameters for an unvoiced signal are pitch and gain. On the other hand, the parameters for a voiced signal are pitch, gain and excitation level.

Unvoiced signal

For an unvoiced signal, at block 210 the contours are extracted from the data $B_{rd1}(n)$ stored in the first residual buffer 130. The contours required for an unvoiced signal are pitch and gain. The pitch contour $\omega_p$ is used to specify the pitch frequency of a speech signal at each update point. For the unvoiced signal, the pitch contour $\omega_p$ is set to zero to distinguish it from a voiced signal.

$$\omega_p(m)=0 \text{ for } m=1 \text{ to } 4.$$

Gain factors $\lambda(m)$ are computed using the residual signal r(n) data $B_{rd1}(n)$ stored in the first residual buffer 130.

$$\lambda(m)=\sqrt{\frac{\sum_{n=n1}^{n=n1+39} b_{rd1}^2(n)}{40}} \quad \text{Eqn 12}$$

where n1=160+40×(m−1) and m=1 to 4.

The encoder parameters must be quantized before being transmitted over the air to the decoder side. For the unvoiced signal, the pitch frequency and gain are quantized at block 212, which then outputs a quantized pitch and quantized gain.

Voiced Signal

Three contours are required for a voiced signal, pitch, gain and excitation level. The four parameters (m) for each these contours are extracted from the instantaneous pitch cycles u(n) every 5 ms. Thus, at block 250 the pitch cycles u(n) are extracted from the data $B_{rd1}(n)$ stored in the first residual buffer 113. The length of each pitch cycle u(n) is known as the instantaneous pitch-period p(m). The value of p(m) is chosen from a range of pitch-period candidates $p_c$. The range of $p_c$ is computed from the estimated pitch-period $p_{est}$ generated by the pitch detector 128. Assume $P_c(1)$ and $P_c(M)$ are the lowest and highest pitch-period candidates, such that:

$$p_c(1)<p_c(2)<p_c(3)< \ldots <p_c(M)$$

The value of $P_c(1)$ and $P_c(M)$ are computed as:

$$p_c(1)=\text{integer}(0.9\times p_{est}) \quad \text{Eqn 13}a$$

$$p_c(M)=\text{integer}(1.1\times p_{est}) \quad \text{Eqn 13}b$$

A cross-correlation function C(k) is then computed for each of the $p_c(k)$. The $p_c(k)$ that yields the highest cross-correlation function is chosen to be the p(m) at the update point. The cross-correlation function C(k) is defined in equation (14).

$$C(p_{ck})=\frac{\sum_{n=n1-1}^{n1-p_{ck}} B_{rd1}(n)B_{rd1}(n-p_{ck})}{\sqrt{\sum_{n=n1-1}^{n1-p_{ck}} B_{rd1}^2(n)\sum_{n=n1-1}^{n1-p_{ck}} B_{rd1}^2(n-p_{ck})}} \quad \text{Eqn 14}$$

The value of n1 is set as 200, 240, 280 and 320 for each update point. After p(m) is obtained, the instantaneous pitch cycle u(n) is extracted from $B_{rd1}(n)$ for the four update points.

Once an instantaneous pitch cycle u(n) is available, the three contours (pitch frequency, gain and excitation level) are computed at block 252. The gain factor λ is calculated using equation (15).

$$\lambda(m)=\sqrt{\frac{\sum_{n=0}^{p(m)-1} u(m)^2(n)}{p(m)}} \quad \text{Eqn 15}$$

To compute the excitation level ϵ, the absolute maximum value for the pitch cycle u(n) is determined using equation (16).

$$A(m)=\max(|u(m,n)|) \text{ for } n=0,1,2,\ldots,p(m)-1 \quad \text{Eqn 16}$$

The excitation level is computed using equation (17).

$$\varepsilon(m)=1-\frac{\lambda(m)}{A(m)} \quad \text{Eqn 17}$$

Finally for the pitch frequency $\omega_p$, a fractional pitch-period p' is first computed from the cross-correlation function $C(p_c(1))\ldots C(p_c(M))$. Suppose the p(m) is the instantaneous pitch-period and $p(m)=p_{ck}$. The fractional pitch-period p'(m) is computed as shown in equation (18).

$$p'(m)=p_{ck}+\frac{1}{2}\left(\frac{C(p_{ck}-1)-C(p_{ck}+1)}{C(P_{ck}-1)-2C(p_{ck})+C(p_{ck}+1)}\right) \quad \text{Eqn 18}$$

The pitch frequency is defined as shown in equation (19).

$$\omega_p(m)=\frac{2\pi}{p'(m)} \quad \text{Eqn 19}$$

Table 2 summarizes the PELP coder parameters.

TABLE 2

Summary of parameters for a PELP encoder

| Parameters | Voiced | Unvoiced |
|---|---|---|
| LSF | $\omega_{li}(4)$ i = 1, 10 | $\omega_{li}(4)$ i = 1, 10 |
| Gain | λ(m) | λ(m) |
| Pitch frequency | $\omega_p(m)$ | 0 |
| Excitation level | ϵ(m) | N/A |

As with the unvoiced parameters, the encoder parameters must be quantized before being transmitted over the air to the decoder side. For the voiced signal, to achieve very low bit rate coding, at block 254, the pitch frequency $\omega_p$ and excitation level ϵ are downsampled to reduce the information content, such as downsampling at 4:1 rate. After the pitch frequency $\omega_p$ and excitation level ϵ are downsampled, they are quantized at block 256. Output from the quantization block 256 are a quantized pitch, quantized gain, and quantized excitation level.

Hence, only one pitch frequency and excitation level is quantized for each 20 ms voiced frame. An example of the quantization scheme for a 1.8 kb/s PELP coder is shown in Table 3.

TABLE 3

Bit allocation table for a 1.8 kb/s PELP coder (VQ—vector quantization)

| Parameters | Bits/ 20 ms frame | Method |
|---|---|---|
| LSF $\omega_{li}(4)$ i = 1, 10 | 20 | Multistage-split VQ |
| Gain $\lambda(m)$ m = 1 to 4 | 7 | VQ on the logarithm gain |
| Pitch frequency $\omega_p(4)$ | 7 | Scalar Quantization |
| Excitation level $\epsilon(4)$ | 2 | Scalar Quantization |

Further quality enhancement may be achieved by reducing the downsampling rate of the pitch frequency $\omega_p$ and the excitation level $\epsilon$, for example to 2:1 and so on, as will be understood by those of ordinary skill in the art.

PELP Decoder

The PELP decoder uses the LP residual parameters generated by the encoder (gain, pitch frequency, excitation level) to reconstruct the LP excitation signal. The reconstructed LP excitation signal is a quasi-periodic signal for voiced speech and a white Gaussian noise signal for unvoiced speech. The quasi-periodic signal is generated by linearly interpolating the pitch cycles at 5 ms intervals. Each pitch cycle is constructed using a deterministic component and a noise component. In addition, the LSF vector is linearly interpolated with the one in the previous frame to obtain an intermediate LSF vector and converted to LPC. After the excitation signal is constructed, it is passed through an LP synthesis filter to obtain the synthesised speech output signal s(n).

The parameters needed for speech synthesis are listed in Table 4. If the parameters are further downsampled for lower bit rates, the intermediate parameters are recovered via a linear interpolation.

TABLE 4

Decoder parameters

| PELP decoder parameters |
|---|
| LSF $\omega_{li}(4)$ |
| Gain $\lambda(m)$ |
| Pitch frequency $\omega_p(m)$ |
| Excitation level $\epsilon(m)$ |

Figure 4:
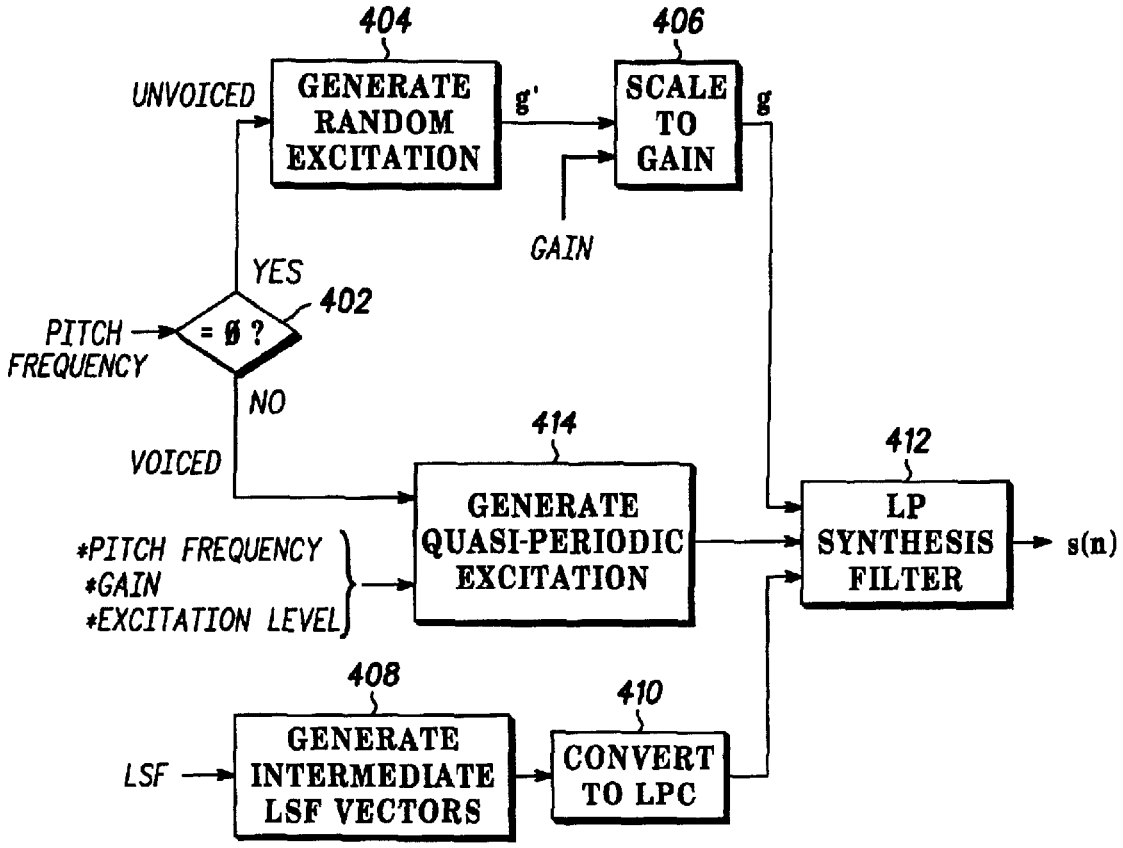
FIG. 4 is a flow diagram of a first PELP decoding scheme in accordance with the present invention.

Referring now to FIG. 4, a flow diagram of a PELP decoding scheme in accordance with the present invention is shown. The speech synthesis process can be separated into two paths, one for voiced signals and one for unvoiced signals. The decision on which path to choose is based on pitch frequency $\omega_p$. At decision block 402, if $\omega_p$ equals zero, an unvoiced signal is synthesized. On the other hand, if $\omega_p$ is greater than zero, a voiced signal is synthesized.

To synthesize an unvoiced speech frame, at block 404 a random excitation signal is generated. More particularly, four segments of a unity-power white-Gaussian sequence (40 samples each) are generated, i.e. g'(m,n) for m=1, 4; n=0, 39. The white Gaussian noise generator is implemented by a random number generator that has a Gaussian distribution and white frequency spectrum. At block 406, each sequence g'(m,n) is scaled to the corresponding gain $\lambda(m)$ to yield g(m,n), as shown by equation (20).

$$g(m, n)=\lambda(m)g'(m, n) \quad \text{Eqn 20}$$

for $m$=1,2,3,4 for $n$=0,1,2, . . . ,39

In addition, using the codebook index $I_L$ generated by the encode (FIG. 1) to access the LSF, four intermediate LSF vectors $\omega_l'(m,i)$ m=1, 4; i=1, 10 for a 20 ms speech frame are calculated at block 408. The four intermediate LSF vectors $\omega_l'$ are then converted to LP filter coefficients a'(m,i) m=1,4; i=1, 10 by linearly interpolating the intermediate LSF vectors across the 20 ms frame at block 410. More particularly, suppose the two boundary LSF vectors are $\omega_l(l-1)$ and $\omega_l'(l)$, the LSF vector $\omega'_l(m,i)$ is then calculated as shown in equation (21).

$$\omega_l'(m,i)=\omega_l(l-1,i)+0.25*m*(\omega_l)l,i)-\omega_l(l-1i)) \quad \text{Eqn 21}$$

for $i$=1,2, . . . , 10

Finally, the synthesized unvoiced speech signal is obtained by passing the Gaussian sequence g(m,n) to an LP synthesis filter 412. The operation of the LP synthesis filter 412 is defined by difference equation (22).

$$s(n) = e(n) - \sum_{i=1}^{10} a_i s(n-i) \quad \text{Eqn 22}$$

where e(n) is the input to the LP synthesis filter. The filtering is done according to Table 5.

TABLE 5

LP synthesis filtering to generate a frame of unvoiced speech

| Excitation signal e(n) | Filter coefficients | Synthesis speech s(n) for n = |
|---|---|---|
| $\{g^{(1)}(n)\}$ | $\{a'^{(1)}_i\}$ | 0 to 39 |
| $\{g^{(2)}(n)\}$ | $\{a'^{(2)}_i\}$ | 40 to 79 |
| $\{g^{(3)}(n)\}$ | $\{a'^{(3)}_i\}$ | 80 to 119 |
| $\{g^{(4)}(n)\}$ | $\{a'^{(4)}_i\}$ | 120 to 159 |

A voiced speech signal is processed differently from an unvoiced speech signal. For a voiced speech signal, a quasi-periodic excitation signal is generated at block 414. The quasi-periodic signal is generated by interpolating the four synthetic pitch cycles in a 20 ms frame. Each synthetic pitch cycle is generated using the corresponding gain $\lambda$, pitch frequency $\omega_p$ and excitation level $\epsilon$.

For example, suppose the synthetic pitch cycle u(n) at an update point within the 20 ms frame is defined in the frequency domain by its pitch-period p, a magnitude spectrum $U_k$ and a phase spectrum $\phi_k$. Only half of the frequency spectrum is used, i.e., k is defined from $$k = 0 \text{ to } k = \frac{(p+1)}{2} - 1.$$

The pitch-period p is calculated as shown in equation (23).

$$p = \text{Integer}\left(\frac{2\pi}{\omega_p}\right) \quad \text{Eqn 23}$$

A flat magnitude spectrum is used in the PELP coding for $U_k$ and is defined as shown in equation (24).

$$U_0=0$$

$$U_k=\lambda\sqrt{p} \quad \text{Eqn 24}$$

The phase spectrum $\phi_k$ includes deterministic phases $\phi_d$ at the lower frequency band and random phase components $\phi_r$ at the higher frequency band.

$$\phi_k = \begin{cases} \phi_{dk} & 0 < k\omega_p \le \omega_s \\ \phi_{rk} & \omega_s < k\omega_p \le \pi \end{cases} \quad \text{Eqn 25}$$

The separation between the two bands is known as the separation frequency $\omega_s$, where:

$$\omega_s = \pi \times \epsilon \quad \text{Eqn 26}$$

The deterministic phases $\phi_d$ are derived from a modified speech production model as shown in equation (27).

$$\phi_{dk} = \tan^{-1}\left(\frac{\alpha\sin(k\omega_p)}{1-\alpha\cos(k\omega_p)}\right) + \tan^{-1}\left(\frac{\gamma\sin(k\omega_p)}{1-\gamma\cos(k\omega_p)}\right) - 2\tan^{-1}\left(\frac{\sin(k\omega_p)}{\beta-\cos(k\omega_p)}\right) \quad \text{Eqn 27}$$

The ways in which $\alpha$, $\beta$ and $\gamma$ can be computed are well understood by those of ordinary skill in the art. The random phase spectrum is generated using a random number generator. The random number generator provides a uniform distributed random number range from 0 to 1.0, which is normalized to 0 and $\pi$.

After the magnitude and phase spectra for the pitch cycle are obtained, they are transformed to real and imaginary spectra for interpolation as shown in equation (28).

$$R_k = |U_k| \cos(\phi_k)$$

$$I_k = |U_k| \sin(\phi_k) \quad \text{Eqn28}$$

To synthesize a voiced excitation, the pitch frequency and the real and imaginary spectra from one pitch cycle to another are linearly interpolated to provide a smooth change of both the signal energy and shape. For example, suppose u(m−1)(n) and u(m) (n) are adjacent pitch cycles (5ms apart). The pitch-frequencies and real and imaginary spectra for the 2 cycles are denoted as $\omega_p(m-1)$, $R_k(m-1)$, $I_k(m-1)$ and $\omega_p(m)$, $R_k(m)$, $I_k(m)$ respectively. The voiced excitation signal v(m)(n) n=0,39 is synthesized from these two pitch cycles using equation (29).

$$v^{(m)}(n) = \frac{1}{p^{(m)}(n)} \sum_{k=1}^{K(n)-1} \{(R_k^{(m-1)k} + \psi(n)(R_k^{(m)} - R_k^{(m-1)})) \cos(k\sigma^{(m)}(n)) + (I_k^{(m-1)} + \psi(n)(I_k^{(m)} - I_k^{(m-1)})) \sin(k\sigma^{(m)}(n))\} \quad \text{Eqn 29}$$

for $n = 0, 1, 2, \ldots, 39$ where $\psi(n)$ is a linear interpolation function defined by equation (30).

$$\psi(n) = \frac{n}{40} \quad \text{Eqn 30}$$

for $n = 0, 1, 2, \ldots, 39$

The value p(m)(n) is the instantaneous pitch-period for each time sample (n), and is computed from the instantaneous pitch frequency $\omega_p(m)(n)$ as shown in equation (31).

$$p^{(m)}(n) = \frac{2\pi}{\omega_p^{(m)}(n)} \quad \text{Eqn 31}$$

The instantaneous pitch frequency $$\omega_p^{(m)}(n)$$

is computed as:

$$\omega_p^{(m)}(n) = \omega_p^{(m-1)} + \psi(n)(\omega_p^{(m)} - \omega_p^{(m-1)}) \quad \text{Eqn 32}$$

K(n) is a parameter related to the instantaneous pitch period as:

$$K(n) = \frac{(p^{(m)}(n) + 1)}{2} \quad \text{Eqn 33}$$

The instantaneous phase value $\sigma^{(m)}(n)$ is calculated via as:

$$\sigma^{(m)}(n) = n\omega_p^{(m-1)} + \frac{n^2}{40}(\omega_p^{(m)} - \omega_p^{(m-1)}) + \sigma^{(m-1)}(40) \quad \text{Eqn 34}$$

for $n = 0, 1, 2, \ldots, 39$

After the four pieces of voiced excitation v(m)(n), m=1,4; n=0,39 are available, they are used as inputs to the LP synthesis filter 412 for synthesizing the voiced speech, in the same manner as is done for unvoiced speech, according to Table 6.

TABLE 6

LP synthesis filtering to generate a frame of voiced speech

| Excitation signal e(n) | Filter coefficients | Synthesis speech s(n) for n = |
|---|---|---|
| $\{v^{(1)}(n)\}$ | $\{a'^{(1)}_i\}$ | 0 to 39 |
| $\{v^{(2)}(n)\}$ | $\{a'^{(2)}_i\}$ | 40 to 79 |
| $\{v^{(3)}(n)\}$ | $\{a'^{(3)}_i\}$ | 80 to 119 |
| $\{v^{(4)}(n)\}$ | $\{a'^{(4)}_i\}$ | 120 to 159 |

A voiced onset frame is defined when a voiced frame is indicated directly after an unvoiced frame. In a voiced onset frame, parameters for pitch cycle $\{u^{(0)}(n)\}$ are not available for interpolating it with $\{u^{(1)}(n)\}$. To solve this problem, the parameters for $\{u^{(1)}(n)\}$ are re-used by $\{u^{(0)}(n)\}$ as shown below, and then the normal voiced synthesis is resumed.

$p(0)=p(1)$ $\omega_p(0)=\omega_p(1)$ $R_k(0)=R_k(1)$ $I_k(0)=I_k(1)$

As is apparent, the present invention provides a Phase Excited Linear Prediction type vocoder. The description of the preferred embodiments of the present invention have been presented for purposes of illustration and description, but are not intended to be exhaustive or to limit the invention to the forms disclosed. It will be appreciated by those skilled in the art that changes could be made to the embodiments described above without departing from the broad inventive concept thereof. For example, the present invention is not limited to a vocoder having any particular bit rate. It is understood, therefore, that this invention is not limited to the particular embodiments disclosed, but covers modifications within the spirit and scope of the present invention as defined by the appended claims.

Table of Abbreviations and Variables

| | |
|---|---|
| AbS | Analysis by Synthesis |
| BPF | Band Pass Filter |
| CELP | Code Excited Linear Predictive |
| LP | Linear Predictive |
| LPC | Linear Predictive Coefficient |
| LSF | Line Spectral Frequencies |
| MPE | Multi-pulse Excited |
| PELP | Phase Excited Linear Predictive |
| RPE | Regular Pulse Excited |
| VBR-PELP | Variable Bit Rate PELP |
| a"(i) | LPC (i = 1, 10) |
| a'(i) | expanded LPC a"(i) |
| a(m, I) | LPC |
| $B_{sp1}(n)$ | Data stored in first speech buffer 113 |
| $B_{sp2}(n)$ | Data stored in second speech buffer 302 |
| $B_{rd1}(n)$ | Data stored in first residual buffer 130 |
| $B_{rd2}(n)$ | Data stored in second residual buffer 306 |
| C(k) | cross-correlation fx for pitch period candidates |
| $C_{est}$ | cross-correlation fx of $P_{est}$ |
| $C_r(m)$ | cross-correlation fx |
| $C_{rest}$ | location of $P_{rest}$ |
| $C_{rmax}$ | global maximum of $C_r(m)$ |
| $C_s(m)$ | cross-correlation fx of LPF speech signal |
| $C_{smax}$ | global maximum of $C_s(m)$ |
| $C_{sest}$ | location of $P_{sest}$ |
| e(n) | LP synthesis filter excitation signal |
| $H_{lp1}(z)$ | transfer function of low pass section of BPF 110 |
| $H_{hp1}(z)$ | transfer function of high pass section of BPF 110 |
| $H_{lp2}(z)$ | transfer function of LPF 300 |
| $I_L$ | codebook index of LSF vector $\omega_1'(i)$ |
| p(m) | instantaneous pitch period |
| $p_c$ | pitch period candidates |
| p' | fractional pitch period |
| $P_{est}$ | estimated pitch period |
| $P_{rest}$ | estimated pitch period of $C_r(m)$ |
| $P_{rmax}$ | position of $C_{rmax}$ |
| $P_{sest}$ | estimated pitch period of $C_s(m)$ |
| $P_{smax}$ | position of $C_{smax}$ |
| r(n) | LP analysis filter residual signal |
| $r_1(n)$ | band limited residual signal |
| $r_u$ | energy distribution of speech signal |
| s'(n) | input speech signal |
| s(n) | speech signal |
| $s_1(n)$ | speech signal output of LPF 300 |
| u(n) | pitch cycle |
| $U_k$ | magnitude spectrum of pitch cycle |
| $\omega_1'(i)$ | LSF from a' (i) |
| $\omega_1$ | intermediate LSF |
| $\omega_p$ | pitch frequency |
| $\lambda$ | gain |
| $\epsilon$ | excitation level |
| $\phi_k$ | phase spectrum of pitch cycle |

What is claimed is:

1. A speech encoder, comprising:

a content extraction module including, a band pass filter that receives a speech input signal and generates a band limited speech signal, a first speech buffer connected to the band pass filter that stores the band limited speech signal, an LP analysis block connected to the first speech buffer that reads the stored speech signal and generates a plurality of LP coefficients therefrom, an LPC to LSF block connected to the LP analysis block for converting the LP coefficients to a line spectral frequency (LSF) vector, an LP analysis filter connected to the LPC to LSF block that extracts an LP residual signal from the LSF vector; and an LSF quantizer connected to the LPC to LSF block that receives the LSF vector and determines an LSF index therefor;

a pitch detector connected to the LP analysis block of the content extraction module, the pitch detector classifying the band filtered speech signal as one of a voiced signal and an unvoiced signal; and a naturalness enhancement module connected to the content extraction module and the pitch detector, the naturalness enhancement module including, means for extracting parameters from the LP residual signal, wherein for an unvoiced signal the extracted parameters include pitch and gain and for a voiced signal the extracted parameters include pitch, gain and excitation level; and a quantizer for quantizing the extracted parameters and generating quantized parameters.

2. The speech encoder of claim 1, wherein the band pass filter comprises an eighth order IIR filter.

3. The speech encoder of claim 2, wherein the IIR filter includes a fourth order low-pass section and a fourth order high pass section.

4. The speech encoder of claim 1, further comprising a scale down unit connected between the band pass filter and the first speech buffer, wherein the scale down unit limits a dynamic range of the band limited speech signal and provides a scaled down signal to the first speech buffer.

5. The speech encoder of claim 4, wherein the scale down unit scales the band limited speech signal by about 0.5.

6. The speech encoder of claim 1, wherein the LP analysis block performs a $10^{th}$ order Burg's LP analysis to estimate a spectral envelope of the stored speech signal and generate the plurality of LP coefficients.

7. The speech encoder of claim 6, wherein a bandwidth expansion block expands the plurality of LP coefficients to generate bandwidth expanded LP coefficients.

8. The speech encoder of claim 1, wherein the naturalness enhancement module uses different update rates to extract each parameter.

9. The speech encoder of claim 8, wherein the update rate of the gain is about 5 mS and the update rates of the pitch frequency and excitation level are about 10 mS.

10. The speech encoder of claim 1, wherein the content extraction module further includes a first residual buffer for storing the LP residual signal.

11. The speech encoder of claim 10, wherein the parameters are extracted from the LP residual signal stored in the first residual buffer.

12. The speech encoder of claim 1, wherein for an unvoiced signal, the pitch parameter is set to zero to distinguish the unvoiced signal pitch from the voiced signal pitch.

13. The speech encoder of claim 1, wherein the naturalness enhancement module further includes a down-sampler connected between the parameter extraction means and the quantizer, for down sampling the parameters prior to quantization.

14. The speech encoder of claim 13, wherein the pitch and excitation parameters are downsampled at a rate of about 4:1.

15. The speech encoder of claim 13, wherein the pitch and excitation parameters are downsampled at a rate of about 2:1.

16. The speech encoder of claim 1, wherein the pitch detector distinguishes between an unvoiced signal and a voiced signal using an RMS value and an energy distribution of the scaled-down, band-filtered speech signal.

17. The speech encoder of claim 1, wherein the pitch detector has three levels of operation depending on an ambiguity level of the scaled-down, band-filtered speech signal.

18. The speech encoder of claim 17, wherein the first level of operation of the pitch detector includes:

a low pass filter that receives the scaled-down, band-filtered speech signal and rejects a high frequency content thereof;

a second speech buffer connected to the low pass filter for storing the low pass filtered signal;

an inverse filter connected to the second speech buffer for generating a band-limited residual signal from the low pass filtered signal stored in the second speech buffer;

a cross-correlation function generator, connected to the inverse filter, for generating a cross-correlation function of the band-limited residual signal;

a peak detector, connected to the cross-correlation function generator, for detecting a global maximum across the cross-correlation function and a location of the global maximum;

a level detector connected to the peak detector for comparing the cross-correlation function global maximum to a predetermined value and based on the comparison result, classifying the input speech signal as one of a voiced signal and an unvoiced signal; and means for generating a first estimated pitch period based on the cross-correlation function.

19. The speech encoder of claim 18, wherein the second level of operation of the pitch detector includes:

means for computing an RMS value of the speech signal;

means for computing an energy distribution of the speech signal; and means for comparing the computed RMS value and the computed energy distribution with first and second cut-off values to determine whether the speech signal is a voiced or unvoiced signal, wherein if the result of the comparison indicates that the speech signal is an unvoiced signal, then the second estimated pitch period is set to zero.

20. The speech encoder of claim 18, wherein the third operation level includes:

means for eliminating multiple pitch errors, connected to the level detector, the multiple pitch error elimination means generating the third estimated pitch period.

21. The speech encoder of claim 18, wherein a cutoff frequency of the low pass filter is about 1000 Hz.

22. A content extraction module for a speech encoder, the content extraction module comprising:

a band pass filter that receives a speech input signal and generates a band limited speech signal, a first speech buffer connected to the band pass filter that stores the band limited speech signal, an LP analysis block connected to the first speech buffer that reads the stored speech signal and generates a plurality of LP coefficients therefrom, an LPC to LSF block connected to the LP analysis block for converting the LP coefficients to a line spectral frequency (LSF) vector, an LP analysis filter connected to the LPC to LSF block that extracts an LP residual signal from the LSF vector; and an LSF quantizer connected to the LPC to LSF block that receives the LSF vector and determines an LSF index therefor.

23. The content extraction module of claim 22, wherein the band pass filter comprises an eighth order IIR filter.

24. The content extraction module of claim 23, wherein the IIR filter includes a fourth order low-pass section and a fourth order high pass section.

25. The content extraction module of claim 22, further comprising a scale down unit connected between the band pass filter and the first speech buffer, wherein the scale down unit limits a dynamic range of the band limited speech signal and provides a scaled down signal to the first speech buffer.

26. The content extraction module of claim 25, wherein the scale down unit scales the band limited speech signal by about 0.5.

27. The content extraction module of claim 22, wherein the LP analysis block performs a $10^{th}$ order Burg's LP analysis to estimate a spectral envelope of the stored speech signal and generate the plurality of LP coefficients.

28. The content extraction module of claim 27, wherein a bandwidth expansion block expands the plurality of LP coefficients to generate bandwidth expanded LP coefficients.

29. The content extraction module of claim 22, further comprising a first residual buffer for storing the LP residual signal.

30. A naturalness enhancement module for a speech encoder, wherein the speech encoder includes a pitch detector for determining whether an input speech signal is a voiced signal or an unvoiced signal and a content extraction module for generating an LP residual signal from the input speech signal, the naturalness enhancement module comprising:

means for extracting parameters from the LP residual signal, wherein for an unvoiced signal the extracted parameters include pitch and gain and for a voiced signal the extracted parameters include pitch, gain and excitation level; and a quantizer for quantizing the extracted parameters and generating quantized parameters.

31. The naturalness enhancement module of claim 30, wherein the naturalness enhancement module uses different update rates to extract the parameters from the LP residual signal.

32. The naturalness enhancement module of claim 31, wherein the update rate of the gain is about 5 mS and the update rates of the pitch frequency and excitation level are about 10 mS.

33. The naturalness enhancement module of claim 31, wherein for an unvoiced signal, the pitch parameter is set to zero to distinguish the unvoiced signal pitch from the voiced signal pitch.

34. The naturalness enhancement module of claim 33, further comprising a down-sampler connected between the parameter extraction means and the quantizer, for down sampling the parameters prior to quantization.

35. The naturalness enhancement module of claim 34, wherein the pitch and excitation parameters are down-sampled at a rate of about 4:1.

36. The naturalness enhancement module of claim 33, wherein the pitch and excitation parameters are down-sampled at a rate of about 2:1.

37. A method of encoding a speech signal, comprising the steps of:

filtering the speech signal to limit a bandwidth thereof;

fragmenting the filtered speech signal into speech segments;

decomposing the speech segments into a spectral envelope and an LP residual signal, wherein the spectral envelope is represented by a plurality of LP filter coefficients (LPC);

converting the LPC into a plurality of line spectral frequencies (LSF);

classifying each speech segment as one of a voiced segment and an unvoiced segment based on a pitch of the segment;

extracting parameters from the LP residual signal, wherein for an unvoiced segment the extracted parameters include pitch and gain and for a voiced segment the extracted parameters include pitch, gain and excitation level; and quantizing the extracted parameters and generating quantized parameters.

38. The method of encoding a speech signal of claim 37, wherein the speech signal is filtered with an eighth order IIR filter.

39. The method of encoding a speech signal of claim 38, wherein the IIR filter includes a fourth order low-pass section and a fourth order high pass section.

40. The method of encoding a speech signal of claim 37, further comprising the step of scaling the filtered speech signal prior to the fragmenting step.

41. The method of encoding a speech signal of claim 37, wherein the decomposing step performs a $10^{th}$ order Burg's LP analysis to estimate the spectral envelope of the speech segments and generate the LP filter coefficients.

42. The method of encoding a speech signal of claim 37, wherein the extracting parameters step uses different update rates to extract each parameter.

* * * * *